US005556345A

United States Patent [19]

Whitesell

[11] Patent Number: 5,556,345

[45] Date of Patent: Sep. 17, 1996

[54] GOLF CLUB WITH IMPROVED SHAFTS

[76] Inventor: Richard F. Whitesell, P.O. Box 66, Clarence, N.Y. 14031

[21] Appl. No.: 511,690

[22] Filed: Aug. 7, 1995

[51] Int. Cl.[6] ..... A63B 53/02; A63B 53/14

[52] U.S. Cl. ..... 473/314; 473/317

[58] Field of Search ..... 273/167 R, 77 R, 273/80 R, 80 B, 80 C, 167 G, 186.2, 187.4, 193 R, 194 R, 162 R, 163 R, 81 R, 81 B; 473/314, 317

[56] References Cited

U.S. PATENT DOCUMENTS

| | | | |
|---|---|---|---|
| 687,540 | 11/1901 | Palmer | 273/80 C |
| 1,974,875 | 9/1934 | Reid . | |
| 3,109,653 | 11/1963 | Briggs . | |
| 3,529,826 | 9/1970 | Hulyk | 273/80 C |
| 4,186,924 | 2/1980 | Southey . | |
| 4,215,860 | 8/1980 | Nakamatsu | 273/81 R |
| 4,679,791 | 11/1984 | Hull . | |
| 4,795,153 | 1/1989 | Thomas . | |
| 4,951,949 | 8/1990 | Kastenhuber | 273/80 C |
| 5,026,062 | 6/1991 | Freeberg | 273/81 B |
| 5,093,162 | 3/1992 | Fenton | 273/80 B |
| 5,209,475 | 5/1993 | Loman | 273/81 C |
| 5,308,073 | 5/1994 | McKoon | 273/80 C |

FOREIGN PATENT DOCUMENTS

| | | | |
|---|---|---|---|
| 689952 | 7/1964 | Canada | 273/80 R |
| 23514 | of 1907 | United Kingdom | 273/80 C |
| 523647 | 7/1940 | United Kingdom | 273/80 R |
| WO8403447 | 9/1984 | WIPO | 273/171 |

*Primary Examiner*—Sebastiano Passaniti
*Attorney, Agent, or Firm*—Howard M. Ellis

[57] ABSTRACT

A golf club adapted to reduce club head rotation during the downswing and when contacting a golf ball, includes a club head, a hand grip portion, and two shafts interconnecting the club head and the hand grip portion. The two shafts converge at the hand grip portion and are spaced from one another at the club head. The second shaft counteracts the tendency of the club head to rotate during the swing and upon contact with the ball. The hand grip portion can employ a grip having at least one flat portion, providing greater directional control over the golf club during the downswing.

19 Claims, 3 Drawing Sheets

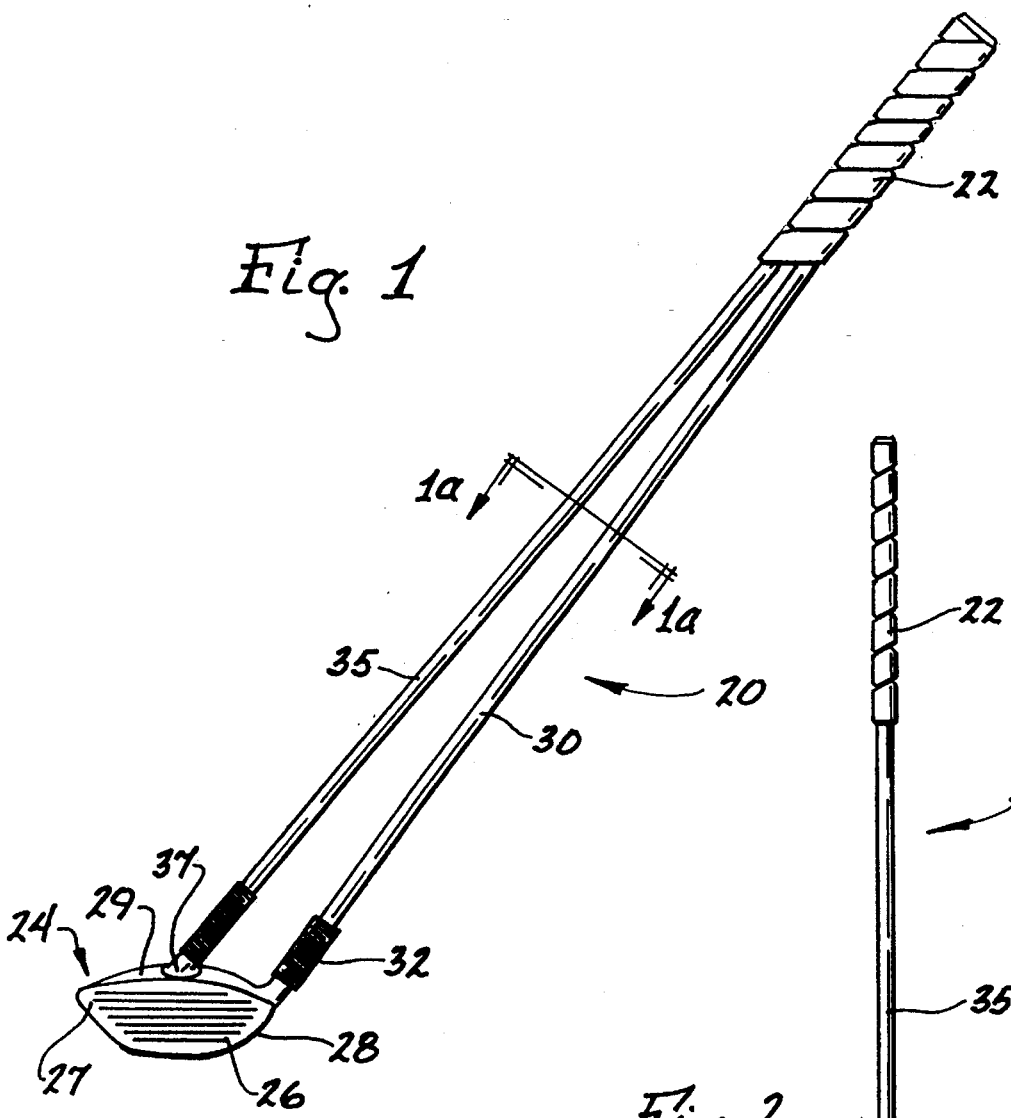
Fig. 1
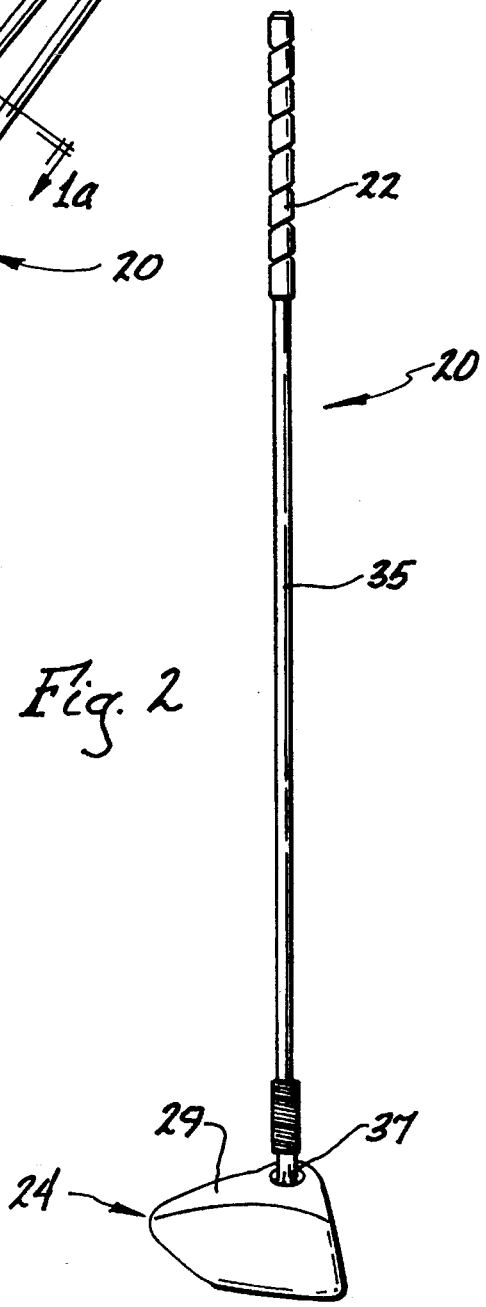
Fig. 2
Fig. 1a
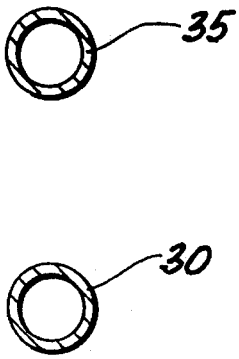

Fig. 3
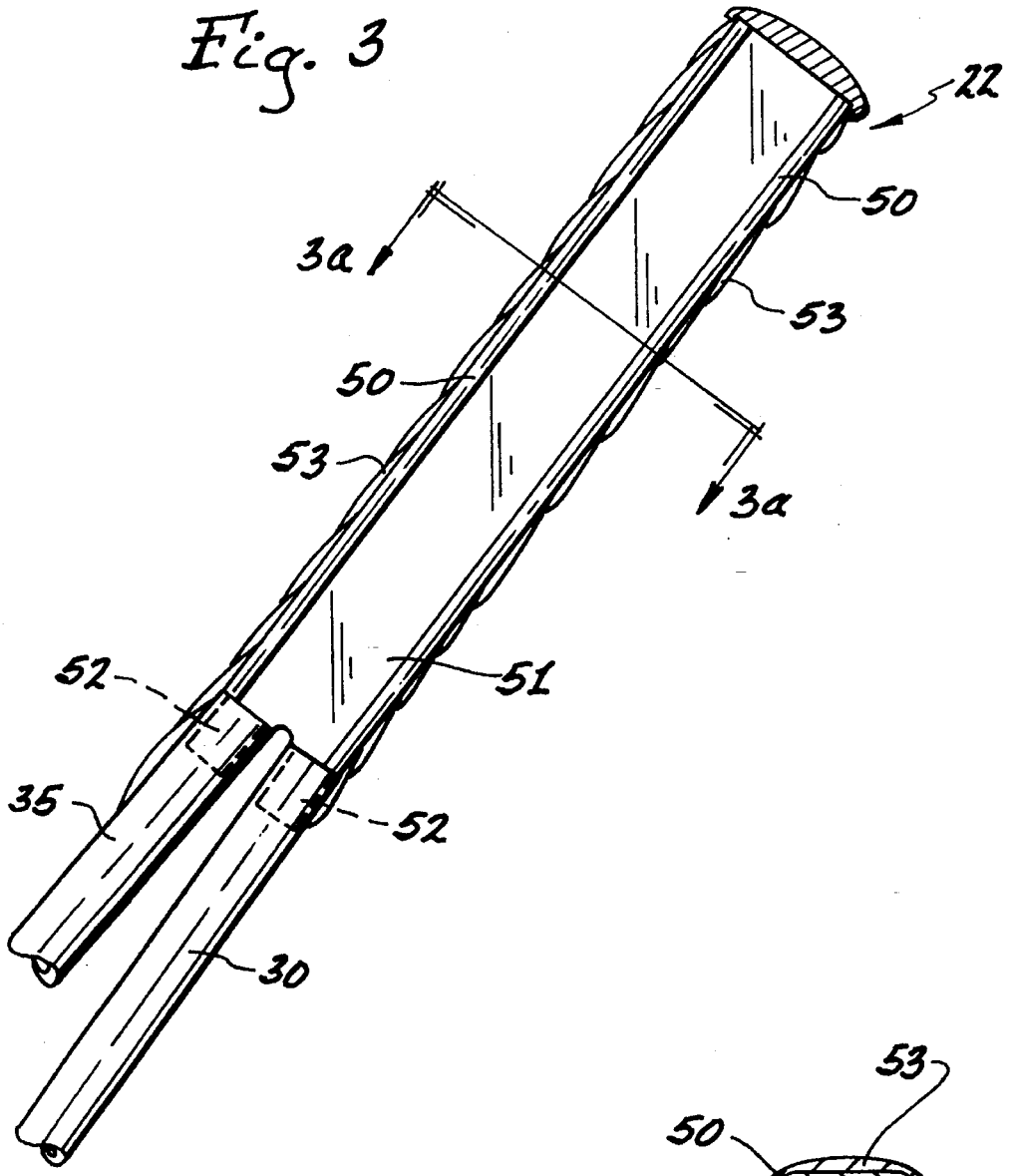
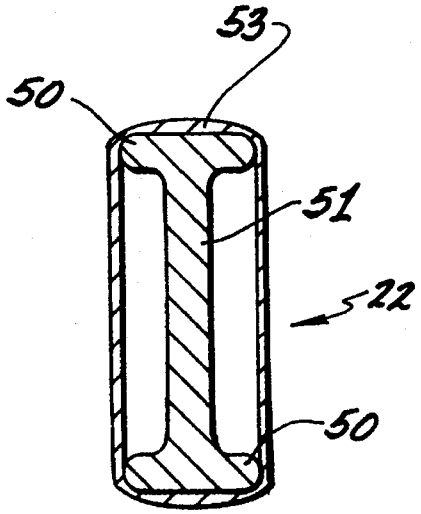
Fig. 3a

GOLF CLUB WITH IMPROVED SHAFTS

TECHNICAL FIELD

The present invention relates to golf clubs having improved shafts and hand grips which allow the ball to be hit with more consistent accuracy in a straight line, providing greater control over the golf swing by reducing the rotation of the shaft and club head during the swing, and upon contact with the ball.

BACKGROUND OF THE INVENTION

Golf, or a pastime similar to the game we know today, has been played for centuries. Since it's beginnings, golf has grown to be one of the world's great past times.

In the game of golf a player employs a set of golf clubs to propel a ball across a course littered with obstacles, from a point where the ball is balanced in mid-air to a point where the ball finishes in the cup. A typical set of golf clubs will include a putter, 4 woods and 9 irons.

The general construction of a golf club includes a hand grip portion, a shaft extending downward from the hand grip portion and a club head at the end of the shaft opposite the hand grip portion. Unlike devices used to contact the ball in other sporting games, a golf club is asymmetrical. That is, the shaft and hand grip are offset from the club head and thus not in line with the point of contact of the club head with the ball.

Because of this offset, a golf club is inherently prone to rotate during the swing. In addition, the club head is prone to rotation about the shaft when the ball is contacted. This rotation of the club head imparts a spin to the ball which results in either a slice, i.e., the ball curves undesirably outward during flight; or a hook, i.e., the ball curves undesirably inward during flight.

There are many golf clubs known in the art designed to minimize this tendency and thereby improve performance of the club. Some efforts are directed at improving performance through redistributing the weight through the club. For example, U.S. Pat. No. 4,679,791 to Hull teaches a golf club with an improved center of gravity. Through proper club weight distribution, rotation of the club head upon striking the ball is reduced.

Other improvements focusing on improving the weight distribution of the club head itself have been introduced. While these efforts have met with some success, a need remains for a club design which utilizes a new approach to the problem of club head rotation and which further reduces the tendency of the club head to rotate during the swing and rotate about the shaft upon contact with the ball.

SUMMARY OF THE INVENTION

In accordance with the invention a new and useful golf club is provided which enables straighter, more accurate golf strokes, and lower resulting scores. Straighter shots are achieved by increasing the golfer's ability to control the direction of the club as it is swung into contact with the ball.

Accordingly the improved golf club is characterized by a shaft configuration which counteracts the tendency of the club head to rotate about the shaft. The shaft configuration of the invention allows the golfer to apply force over a greater area of the club head, thereby more effectively counteracting the torsional twisting of the club head about the shaft when the club is in motion.

The invention is further characterized by an improved hand grip having a flat portion. This allows greater directional control over the club during the swing and further minimizes club head rotation It is therefore a principal object to provide a golf club which reduces the rotational movement of the club head about the shaft during the swing and when the club head strikes the ball. Such a device comprises a plurality of club shafts each having first and second terminal end portions; a club head; means for gripping the golf club; each of the club shafts being affixed to the club head at the first terminal end portions The means for gripping the golf club is affixed to the second terminal end portions of the club shafts and may include at least one flat portion.

The club shafts are substantially linear between the first and second terminal end portions and are preferably tubular, i.e., hollow and elongated, or comprised of rods, i.e., solid, non-hollow and elongated. The club shafts are preferably spaced from one another at the first end and converge at the second end, but can also be substantially parallel.

The invention also contemplates a golf club wherein the second terminal end portions of the first and second club shafts meet to form a generally "T" shaped terminal end portion for gripping the club so as to reduce torque on the club head.

It is a further object of the invention to provide for a golf club having first and second club shafts, a club head having a heel portion, a toe portion, a sole portion, a top portion and a ball striking face wherein the first club shaft is affixed to the club head through a socket or hosel usually at the heel portion, and the second club shaft is affixed to the club head through a hosel positioned at a point between the heel portion and the toe portion, usually spaced from the first club shaft.

It is a further object of the invention to provide a golf club comprising a club head which includes a heel portion, a toe portion, a sole portion, a top portion and a ball striking face. The club head is located at a first end of the golf club, a hand grip is located at a second end of the golf club opposite the first end, and a shaft portion interconnects the hand grip with the club head. The shaft has hollow sections along its length for decreasing air resistance, and the shaft portion may be wider at the first end than at the second end. Accordingly, this embodiment of the invention also includes multiple shafts, interconnected with cross members.

The shaft portion, handle, and club head are preferably axially aligned and the shaft portion may have at least one flat section.

BRIEF DESCRIPTION OF THE DRAWINGS

For a further understanding of the invention, as well as its characterizing features reference should now be made to the accompanying drawings wherein:

FIG. 1 is an elevational view of a driver;

FIG. 1*a* is a sectional view taken along line 1*a*—1*a* of FIG. 1;

FIG. 2 is a front elevational view of the golf club of FIG. 1;

FIG. 3 is an enlarged view of the hand grip portion of the golf club of FIG. 1;

FIG. 3*a* is a sectional view of the hand grip portion of the club taken along line 3*a*—3*a* of FIG. 3;

DESCRIPTION OF THE PREFERRED EMBODIMENTS

Figure 5:
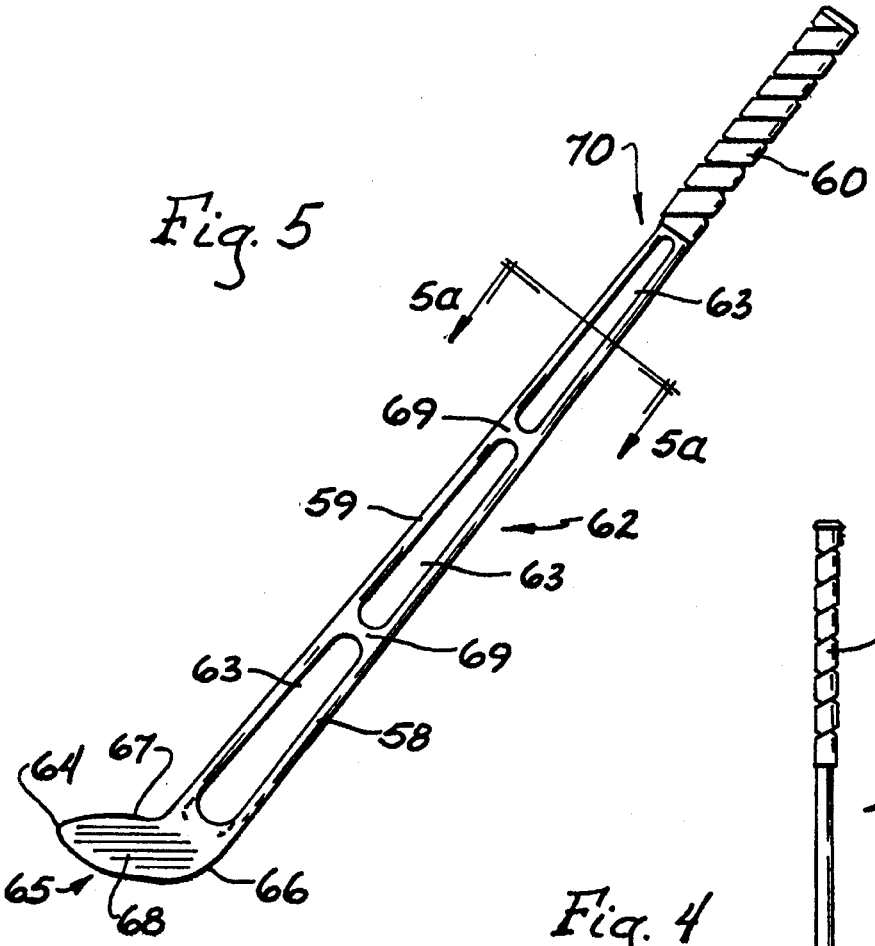
FIG. 5 is a side elevational view of the golf club of FIG. 4.

FIG. 1 shows a side elevational view of a golf club 20 according to the present invention. Golf club 20 is depicted as a driver, but it is to be understood that the invention encompasses all types of clubs with shafts of varying lengths normally making up a set of golf clubs. This includes drivers, fairway woods, irons and to a lesser extent, putters. Club heads may be comprised of wood, metals, metal alloys and other state-of-the-art materials.

Golf club 20 has a hand grip 22 at a terminal end, a club head 24 for striking the ball comprising a ball striking face 26, toe 27, heel 28 and top portion 29. Golf club 20 also has a first shaft 30, extending linearly from hand grip 22 to heel 28. Shaft 30 is connected to heel 28 of club head 24 by means of a hosel 32.

A second shaft 35 extends linearly from the hand grip 22 to a point on top portion 29, between the heel 28 and toe 27. Preferably, the second shaft is spaced from the first shaft at the club head. Club head 24 includes a hosel 37 for affixing second shaft 35 to club head 24. In the preferred embodiment hosel 37 is a socket which is welded, or otherwise affixed to, or made a part of club head 24. Other means of combining hosel 37 with club head 24 in order to connect second shaft 35 with club head 24 will be apparent to those skilled in the art and remain within the scope of the present invention.

In the preferred embodiment, shafts 30 and 35 are hollow and tubular as depicted in FIG. 1*a*. However, other types of shafts are contemplated including solid or rod type shafts. Shaft material can be any strong, lightweight or composite material. Suitable materials include steel, aluminum, titanium, carbon, boron, carbon fiber, graphite and mixtures thereof.

Shafts 30 and 35 are spaced from one another at club head 24 and converge at hand grip 22 forming one end of golf club 20. For purposes of this invention the expressions "hand grip", "means for gripping the club", and other similar expressions appearing in the specification and claims are intended to refer to the terminal end portion of the club shaft and is actually engaged by the user during play.

FIG. 2 shows a front view of the golf club of the present invention. Only second shaft 35 is visible from this view. Hand grip 22 is affixed to one end of second shaft 35. The other end of second shaft 35 is affixed to club head 24 at top portion 29 by interconnecting with hosel 37.

FIG. 3 is a view of the hand grip portion 22 of the golf club of FIG. 1. In a preferred embodiment inner piece 51 may be a lightweight material, e.g., metal, plastic, etc., having two extensions 52 formed to fit within the terminal end portions of shafts 35 and 30. However, other means of terminating shafts 35 and 30 at the hand grip will be apparent to those skilled in the art and are intended to be within the scope of the present invention.

In one preferred embodiment, inner piece 51 may be comprised of a flattened solid member having flanged ends 50, best illustrated in FIG. 3*a*. Flanged ends 50 provide a wider,.more secure gripping surface, avoiding the undesirable rotational movement associated with more conventional round hand grips.

FIG. 3*a* shows flanged ends 50 having a generally "I" shape, with inner piece 51 forming the intermediate member of the "I". As opposed to a round hand grip, which is inherently more likely to twist during the swing and upon contacting the ball, a hand grip having a substantially "I" or rectangular configuration gives greater control of the club and directional control over the ball.

Hand grip 22 is provided with an outer wrapping 53 consisting of leather tape or other suitable hand grip material to provide a slip resistant and comfortable gripping surface.

Figure 4:
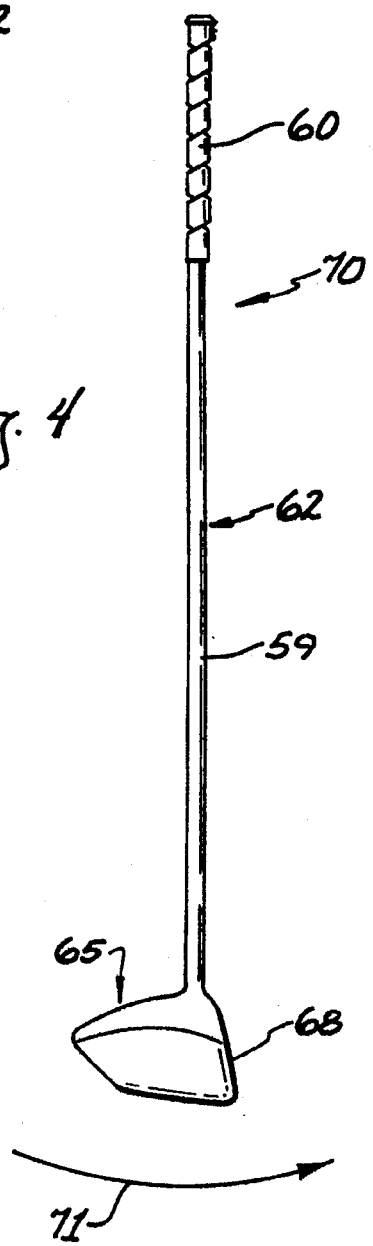
FIG. 4 is a front elevational view of the golf club of a second embodiment of the invention.

FIGS. 4 and 5 relate to a further embodiment of the golf club incorporating the concepts of the present invention for reducing the rotational movement of the club head about the shaft when the club head strikes the ball.

FIG. 4 shows a front view of a second embodiment of a golf club 70 according to the present invention. Golf club 70 comprises hand grip 60, shaft portion 62, and club head 65 having a ball-striking face 68. The ball striking direction is indicated by arrow 71.

Figure 5A:
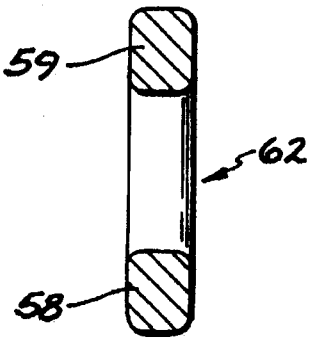
FIG. 5*a* is a sectional view of the shaft portion of the club of FIGS. 5 taken along line 5*a*—5*a*.

FIG. 5 is a side elevational view of golf club 70. Golf club 70 includes hand grip 60, a shaft portion 62 and a club head 65. Unlike the tubular shafts of the previous embodiment, shaft portion 62 has a flat cross section in the ball striking direction of golf club 70 as best illustrated in FIG. 5*a*. In other words, shaft portion 62 is flat in a direction roughly corresponding to the plane of ball-striking face 68 of golf club 70. Shaft portion 62 comprises a plurality of hollow sections 63 to minimize air resistance as shaft portion 62 and golf club 7! 0 are swung.

Shaft portion 62 can be comprised of dual shafts 58 and 59 and can have one or more cross members 69 interconnecting shafts 58 and 59. Cross members 69 reduce the relative movement between shafts 58 and 59 and stabilize shaft portion 62.

Shaft portion 62 is connected to club head 65 in an area running across top portion 67 from heel 66 to a point between heel 66 and toe 64. Shaft portion 62 may be wider where it connects with club head 65, and narrower where it connects with hand grip 60.

While the invention has been described in conjunction with various embodiments, they are illustrative only. Accordingly, many alternatives, modifications and variations will be apparent to persons skilled in the art in light of the foregoing detailed description. It is therefore intended that the foregoing descriptions embrace all such alternatives and variations as to fall within the spirit and broad scope of the appended claims.

I claim:

1. A golf club comprising:

a plurality of club shafts each having first and second terminal end portions, a club head, means for gripping said golf club, each of said club shafts being affixed to said club head as measured from a toe portion of the club head at said first terminal end portions of said shafts at angles which are obtuse to the generally horizontal plane of said club head, and said means for gripping said golf club being affixed axially to said club shafts at said second terminal end portions of said club shafts, each of said shafts being spaced from one another for the length of said club shafts except for said second terminal end portions wherein said shafts generally converge.

2. The golf club of claim 1 wherein said club shafts are substantially linear between said first and second terminal end portions.

3. The golf club of claim 1 wherein said club shafts are tubular.

4. The golf club of claim 1 wherein said club shafts are rods.

5. The golf club of claim 1 wherein said means for gripping said golf club has at least one flat portion.

6. The golf club of claim 1 wherein said club shafts are fabricated from a material selected from the group consisting of steel, titanium, carbon, boron and mixtures thereof.

7. The golf club according to claim 6 wherein said carbon material is carbon fiber.

8. The golf club according to claim 6 wherein said carbon material is graphite.

9. The golf club of claim 1 wherein said golf club is a driver.

10. The golf club of claim 1 wherein said golf club is an iron.

11. The golf club of claim 1 wherein said golf club is a putter.

12. The golf club of claim 1 comprising:

first and second club shafts;

said club head comprising a heel portion, a toe portion, a sole portion, a top portion and a ball striking face;

said first club shaft affixed to said club head at the heel portion, and said second club shaft affixed to said club head at a point between the heel portion and the toe portion.

13. The golf club according to claim 12 wherein said second terminal end portions of said first and second club shafts are joined to one another through an intermediate cross member.

14. A golf club, which comprises a club head, multiple linear club shafts affixed to said club head at first terminal end portions of said shafts at angles which are obtuse to the generally horizontal plane of said club head as measured from a toe portion of the club head and means for gripping said club affixed to said club shafts at second terminal end portions, said club shafts being spaced from one another for the length of said club shafts and generally converging at said gripping means.

15. The golf club of claim 14 wherein the means for gripping the club comprises at least one flat portion.

16. A golf club selected from the group consisting of a driver and an iron, said club comprising:

first and second clubs shafts each having first and second terminal end portions, a club head having a ball striking face, a toe portion, a heel portion and a top portion, means for gripping said golf club, the first terminal end portions of said club shafts being affixed to said heel and top portions, respectively, of said club head, the second terminal end portions of said club shafts being affixed to said means for gripping said golf club, said first and second club shafts being substantially parallel and spaced from one another for the length of said club shafts and generally converge at said gripping means.

17. A golf club comprising:

a club head comprising a heel portion, a toe portion, a sole portion, a top portion and a ball striking face, said club head located at a first end of said golf club;

a hand grip located at a second end of said golf club opposite the first end, and a shaft portion interconnecting said hand grip with said club head, said shaft portion having hollow sections along said shaft portion for decreasing air resistance, said shaft portion affixed to said heel and top portions of said club head.

18. The golf club of claim 17 wherein said shaft portion, hand,grip and club head are axially aligned.

19. The golf club according to claim 17 wherein said shaft portion has at least one flat portion.

* * * * *

UNITED STATES PATENT AND TRADEMARK OFFICE

CERTIFICATE OF CORRECTION

PATENT NO. : 5,556,345
DATED : September 17, 1996
INVENTOR(S) : Richard F. Whitesell It is certified that error appears in the above-indentified patent and that said Letters Patent is hereby corrected as shown below:

Column 4, lines 55-56 "as measured from a toe portion of the club head" is deleted and the same language is inserted in column 4, line 58 after " ...said club head"

Signed and Sealed this

Fourteenth Day of January, 1997

*Attest:*

Bruce Lehman

BRUCE LEHMAN

*Attesting Officer*

*Commissioner of Patents and Trademarks*